US005921198A

United States Patent [19]

Yoshida

[11] Patent Number: 5,921,198

[45] Date of Patent: Jul. 13, 1999

[54] SMALL WATERCRAFT HULL

[75] Inventor: Tatsuya Yoshida, Shizuoka, Japan

[73] Assignee: Yamaha Hatsudoki Kabushiki Kaisha, Japan

[21] Appl. No.: 08/854,493

[22] Filed: May 12, 1997

[30] Foreign Application Priority Data

May 10, 1996 [JP] Japan ..... 8-116457

[51] Int. Cl.[6] ..... B63B 5/24

[52] U.S. Cl. ..... 114/357; 114/270

[58] Field of Search ..... 114/78, 292, 270, 114/352, 354, 355–359

[56] References Cited

U.S. PATENT DOCUMENTS 5,647,779 7/1997 Nanami ..... 114/270

FOREIGN PATENT DOCUMENTS 2420560 12/1974 Germany ..... 114/78

*Primary Examiner*—Jesus D. Sotelo

*Attorney, Agent, or Firm*—Knobbe, Martens, Olson & Bear, LLP

[57] ABSTRACT

An improved watercraft hull design includes an integral locator mechanism to establish the location and the orientation of a bulkhead within the watercraft hull. The locator mechanism includes a plurality of posts that cooperate with a plurality of openings. The posts are formed on the hull, and the openings are formed in the bulkhead. The corresponding pairings of post and opening cooperate with one another to set the desired location and orientation of the bulkhead with the hull. Fasteners can be used to further fix the position of the bulkhead.

34 Claims, 5 Drawing Sheets

SMALL WATERCRAFT HULL

BACKGROUND OF THE INVENTION

1. Field of the Invention

The present invention relates in general to a small watercraft, and in particular to a hull construction for a small watercraft.

2. Description of Related Art

Personal watercrafts have become popular in recent years. This type of watercraft is sporting in nature; it turns swiftly, is easily maneuverable, and accelerates quickly. Personal watercraft today commonly carrier one rider and possibly one or two passengers.

A relatively light weight, small hull of the personal watercraft defines an engine compartment below a rider's area. An internal combustion engine frequently lies within the engine compartment in front of a tunnel formed on the underside of the watercraft hull. The internal combustion engine powers a jet pump unit located within the tunnel. An impeller shaft commonly extends between the engine and the jet pump unit for this purpose.

One end of the impeller shaft is coupled to an output shaft of the engine while the other end extends into the jet pump unit and drives an impeller. The orientation of the impeller shaft within the hull therefore is fixed by the mounted positions of the engine and the jet pump unit within the hull.

A bearing assembly, which is affixed to a bulkhead, supports the impeller shaft between the engine and the jet pump unit in many personal watercraft. The position and orientation of the bearing assembly, and thus the bulkhead, within the hull thus becomes important in order to properly support the impeller shaft. Misalignment occurring between the bearing assembly and the impeller shaft causes increased wear between these components and often produces stress within other components of the drive train, such as in the coupling between the impeller shaft and the engine output shaft.

For this purpose, the bulkhead often is bonded into the hull using a jig. The jig is placed in the hull, usually flush against the transom. In this position, the front end of the jig establishes the position and the orientation of the bulkhead. After the bulkhead is attached to the lower hull section, the jig is removed and the upper deck of the hull is attached.

Use of a jig to locate the position and orientation of the bulkhead within the hull poses several drawbacks. Position and orientation errors of the transom are translated to the bulkhead using this manufacturing technique. Manufacturing errors caused by incorrect positioning of the jig within the hull also attribute to the occasional mispositioning of the bulkhead. And such positioning errors often translate into increased friction and stress between the impeller shaft and the bearing assembly attached to the bulkhead.

SUMMARY OF THE INVENTION

A need therefore exists for a manufacturing method employing an improved procedure to locate and oriente the bulkhead within the hull during the assembly process.

One aspect of the present invention thus involves a watercraft comprising a hull. The hull has a longitudinal axis that extends between fore and aft ends and is formed at least in part by a pair of side walls and a bottom wall. The bottom wall interconnects and separates at least corresponding portions of the side walls. A bulkhead is positioned between the corresponding side wall portions and above the bottom wall. Interacting locator members are positioned between the bulkhead and the hull to establish a location of the bulkhead along the longitudinal axis of the hull and an orientation of the bulkhead between the walls.

A preferred method of forming the watercraft involves forming a hull having a longitudinal axis that extends between fore and aft ends. The hull is formed at least in part by a pair of side walls and a bottom wall that interconnects and separates at least corresponding portions of the side walls. Bosses are formed on the bottom surface of the hull with the bosses being arranged in a lateral direction that is generally normal to the longitudinal direction. Each boss is formed with a generally upright post. A bulkhead is also formed and is sized to fit between the side surfaces in a position generally normal to the longitudinal axis of the hull. The bulkhead is formed with lugs that include openings to receive the posts of the bosses. The bulkhead is positioned within the hull between the side walls and above the bottom wall with at least portions of each lug being positioned above the corresponding boss. The post of each boss is inserted into the corresponding hole in the respective lug. The bulkhead is then moved along the longitudinal axis toward the fore end of the hull to interact at least some of the posts with abutment surfaces formed within the corresponding openings. The bulkhead is coupled to the hull in this position. The interaction between the posts and the openings of the lugs, as well as between the lugs and the bosses, establishes a position and an orientation of the bulkhead within the hull.

Further aspects, features, and advantages of the present invention will become apparent from the detailed description of the preferred embodiment which follows.

Brief Description of the Drawings

The above-mentioned and other features of the invention will now be described with reference to the drawings of a preferred embodiment of the present watercraft. The illustrated embodiment is intended to illustrate, but not to limit the invention. The drawings contain the following figures.

DETAILED DESCRIPTION OF PREFERRED EMBODIMENTS OF THE INVENTION

The present hull design and construction has particular utility for use with personal watercraft, and thus, the following describes the hull in the context of a personal watercraft. This environment of use, however, is merely exemplary. The present hull design can be readily adapted by those skilled in the art for use with other types of watercraft as well, such as, for example, but without limitation, small jet boats and the like.

Figure 1:
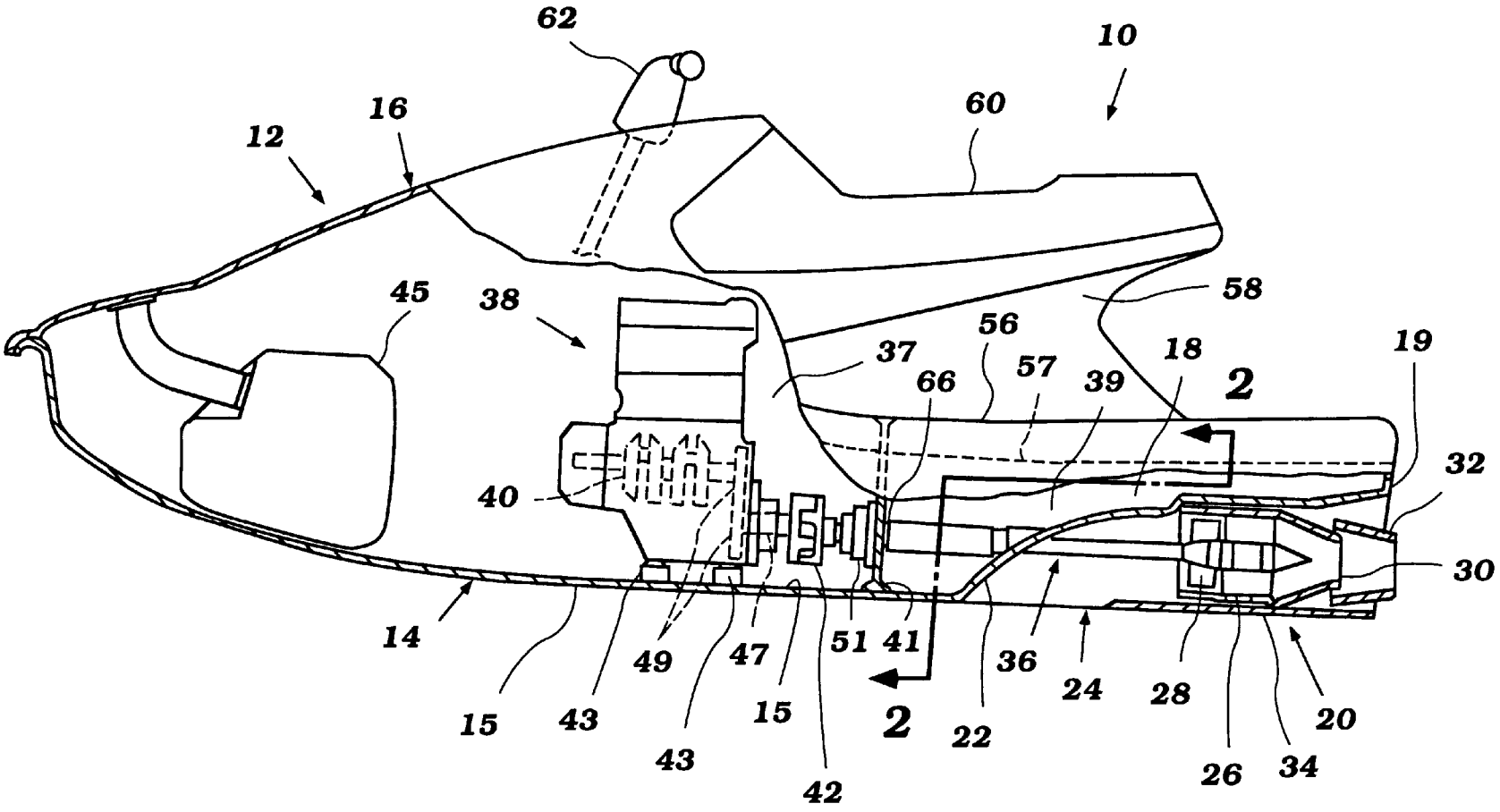
FIG. 1 is a partial sectional side elevational view of a personal watercraft including a hull configured in accordance with a preferred embodiment of the present invention.
Figure 2:
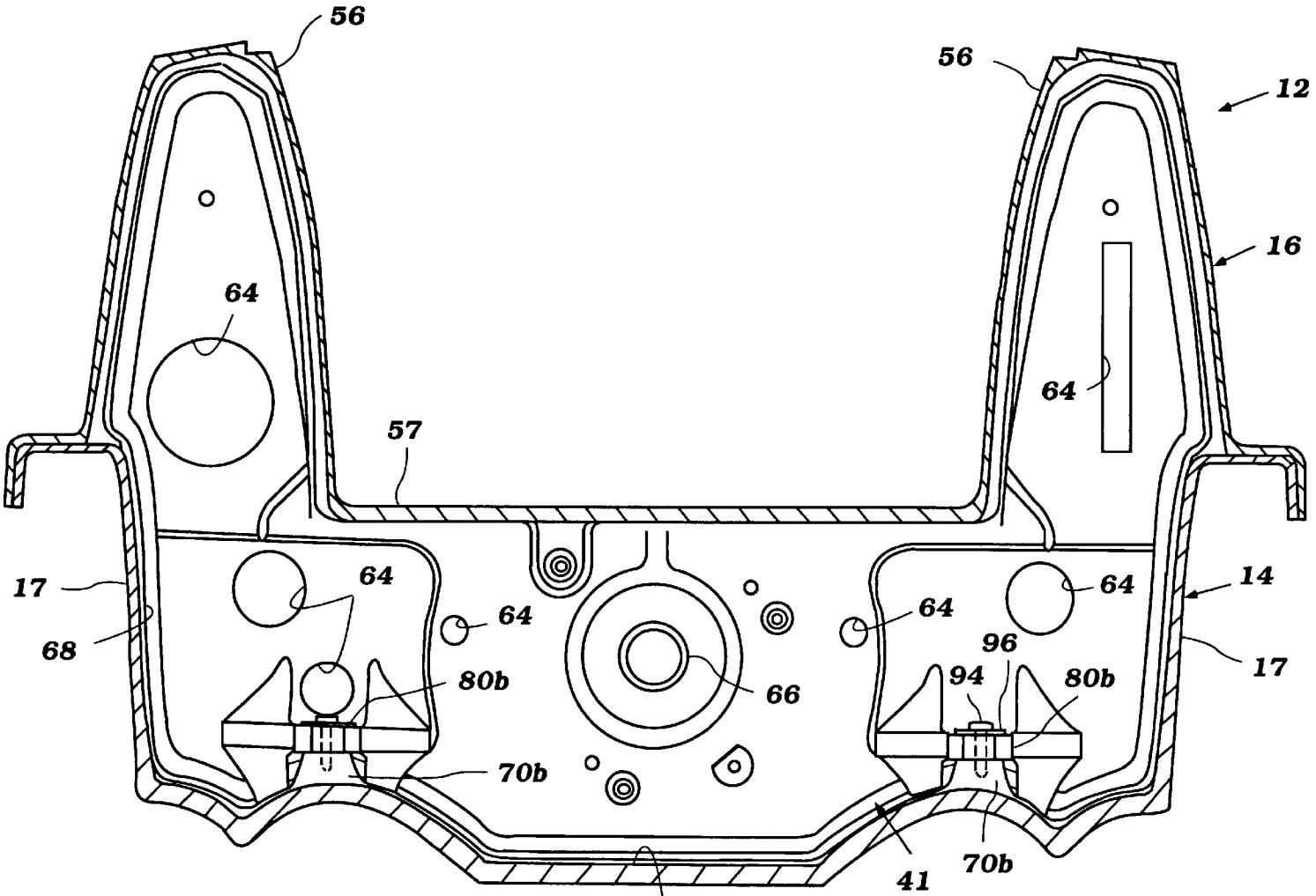
FIG. 2 is a cross-sectional view of the watercraft hull of FIG. 1 taken along line 2—2.
Figure 3:
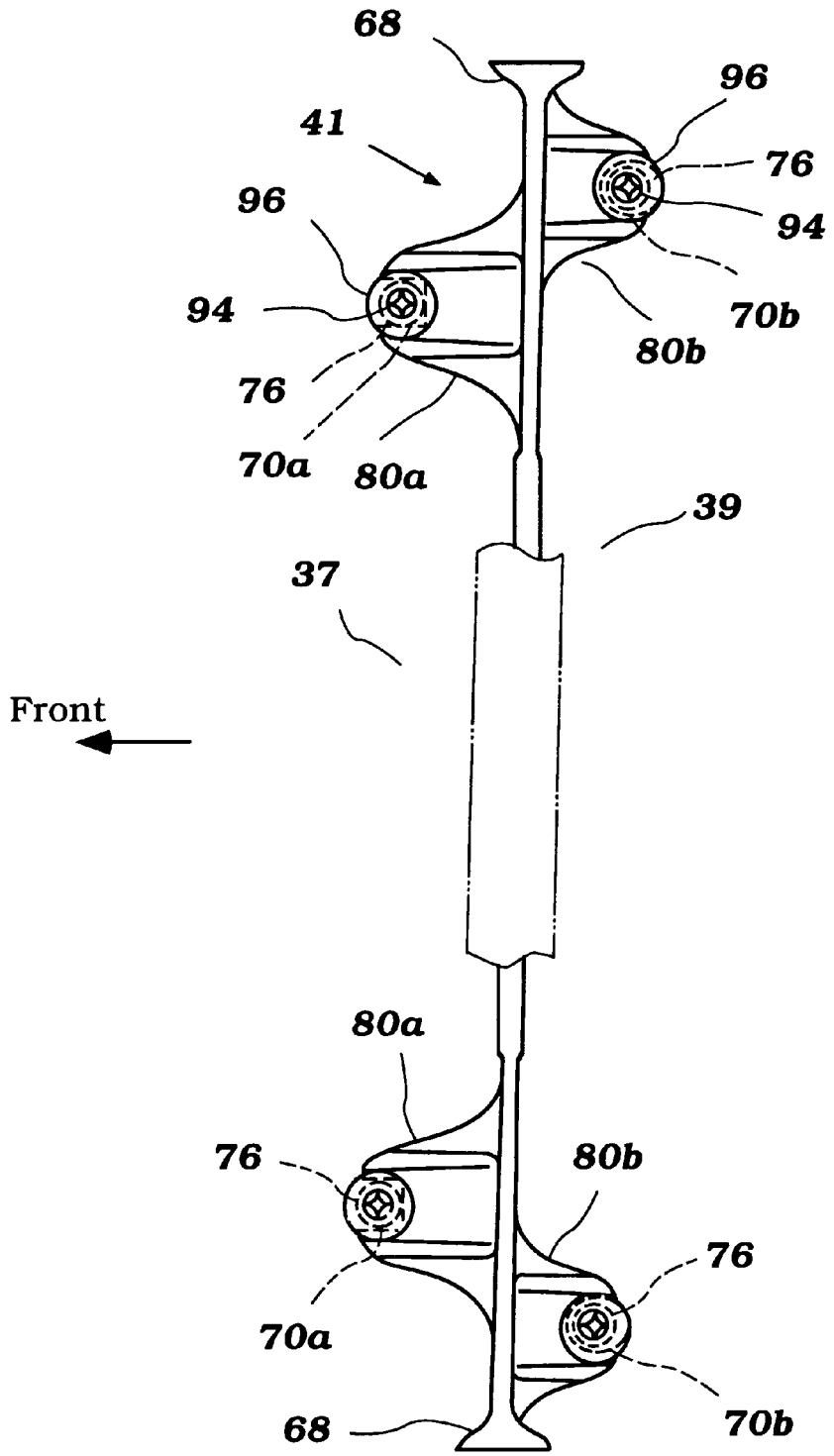
FIG. 3 is a partial top plan view of a bulkhead assembly of the hull of FIG. 2.

With initial reference to FIGS. 1 and 2, the watercraft 10 includes a hull 12 that is formed by a lower hull section 14 and an upper deck section 16. The hull sections 14, 16 are formed of a suitable material such as, for example, a molded fiberglass reinforced resin, and can be made by any of a wide variety of methods. For instance, the deck 16 and hull 14 can each be formed using a sheet molding compound (SMC), i.e., a mixed mass of reinforced fiber and thermosetting resin, that is processed in a pressurized, closed mold. The molding process desirably is temperature controlled such that the mold is heated and cooled during the molding process. For this purpose, male and female portions of the mold can include fluid jackets through which steam and cooling water can be run to heat and cool the mold during the manufacturing process.

The lower hull section 14 and the upper deck section 16 are fixed to each other around their peripheral edges in any suitable manner. For instance, the peripheral flanges of the upper deck 16 and the lower hull 14 can be bonded together.

The lower hull 14 is designed such that the watercraft 10 planes or rides on a minimum surface area of the aft end of the lower hull 14 in order to optimize the speed and handling of the watercraft 10 when up on plane. For this purpose, the lower hull section 14 generally has a V-shaped bottom wall 15 configuration formed by a pair of inclined section that extend outwardly from the keel line to outer chines at a dead rise angle. The inclined sections extend longitudinally from the bow toward the transom of the lower hull 14 and extend outwardly to side walls 17 of the lower hull 14. The side walls 17 are generally flat and straight near the stem of the lower hull 14 and smoothly blend towards the longitudinal center of the watercraft 10 at the bow. The lines of intersection between end inclined section of the bottom wall 15 and the corresponding side wall 17 form the outer chines of the lower hull section 14.

Toward the transom 19 of the watercraft, the incline sections of the lower hull extend outwardly from a recessed channel or tunnel 18 that extends upward toward the upper deck portion 16. The tunnel 48 has a generally parallelepiped shape and opens through the rear of the transom 19 of the watercraft 10, as understood from FIG. 1.

In the illustrated embodiment, a jet pump unit 20 propels the watercraft 10. The jet pump unit 20 is mounted within the tunnel 18 formed on the underside of the lower hull section 14 by a plurality of bolt. An intake duct 22 of the jet pump unit 20 defines an inlet opening 24 that opens into a gullet of the duct. The duct gullet leads to an impeller housing 26 in which the impeller 28 of the jet pump 20 operates. An impeller duct assembly, which acts as a pressurization chamber, delivers the water flow from the impeller housing 26 to a discharge nozzle housing 30.

A steering nozzle 32 is supported at the downstream end of the discharge nozzle by a pair of vertically extending pivot pins. In an exemplary embodiment, the steering nozzle 32 has an integral lever on one side.

A ride plate 34 covers a portion of the tunnel 18 behind the inlet opening 24 to enclose the pump chambers and the nozzle assembly 30 within the tunnel 18. In this manner, the lower opening of the tunnel 18 is closed to provide in part a planing surface for the watercraft.

An impeller shaft 36 supports the impeller 28 within the impeller housing 26. The aft end of the impeller shaft 36 is suitable supported and journalled within the compression chamber in a known manner. The impeller shaft 36 extends in the forward direction through a front wall of the duct 22.

The lower hull portion 14 principally defines an engine compartment 37 and a pump chamber 39 which is primarily formed above the tunnel 18. A bulkhead 41 divides the compartments 37, 39. Except for some conventional air ducts, the engine compartment 37 is normally substantially sealed so as to enclose an engine and the fuel system of the watercraft 10 from the body of water in which the watercraft is operated. The pump chamber 39 likewise is principally sealed from the intrusion of water.

An internal combustion engine 38 of the watercraft powers the impeller shaft 36 to drive the impeller 28 of the jet pump unit 20. The engine 38 is positioned within the engine compartment 37 and is mounted centrally within the hull 12. Vibration-absorbing engine mounts 43 secure the engine 38 to the bottom wall 15 of the lower hull portion 14 in a known manner.

In the illustrated embodiment, the engine 38 includes two in-line cylinders and operates on a four-stroke principle. The engine 38 is positioned such that the row of cylinders lies parallel to a longitudinal axis of the watercraft 10, running from bow to stern. This engine type, however, is merely exemplary. Those skilled in the art will readily appreciate that the present hull can be used with any of a variety of engine types having other number of cylinders, having other cylinder arrangements and operating on other combustion principles (e.g., two-stroke crankcase compression principle).

A cylinder block and a cylinder head assembly desirably form the cylinders of the engine. A piston reciprocates within each cylinder of the engine 38 and together the pistons drive a crankshaft 40, in a known manner. The crankshaft 40 desirably is journalled with a crankcase, which in the illustrated embodiment is formed between a crankcase member and a lower end of the cylinder block. A connecting rod links the corresponding piston to the crankshaft 40. The corresponding cylinder bore, piston and cylinder head of each cylinder forms a variable-volume chamber, which at a minimum volume defines a combustion chamber.

Each combustion chamber communicates with a charge former of an induction system. The induction system receives air through a throttle device and fuel from a fuel tank 45, which is positioned within the hull 12, and produces the fuel charge which is delivered to the cylinders in a known manner.

The crankshaft 40 drives an output shaft 47 of the engine 38. For this purpose, the engine 38 includes a drive mechanism 49 positioned at the engine's aft end. The drive mechanism 49 operates between the crankshaft 40 and the output shaft 43 to transfer power between the shafts 40, 47. In some cases, the drive mechanism 49 can step down the rotational speed of the output shaft 45 relative to the crankshaft 40. In such applications, the drive mechanism 49 desirably comprises a gear train; however, a belt or chain mechanism also can be used.

As seen in FIG. 1, a coupling 42 interconnects the engine output shaft 47 to the impeller shaft 36. A bearing assembly 51, which is secured to the bulkhead 41, supports the impeller shaft 36 behind the shaft coupling 42.

An exhaust system (not shown) is provided to discharge exhaust byproducts from the engine 38 to the atmosphere and/or to the body of water in which the watercraft 10 is operated. The exhaust system includes an exhaust manifold that is affixed to the side of the cylinder block and which receives exhaust gases from the variable-volume chambers through exhaust ports in a well-known manner. An exhaust pipe extends from the manifold to a water trap device. The exhaust pipe can include one or more expansion chambers along its length and can house a catalytic treatment system. A cooling jacket also desirably extends along at least a portion of the exhaust pipe's length and communicates with the exhaust pipe at some point in order to introduce cooling water into the exhaust stream for silencing purposes. A downstream exhaust pipe is connected to the water trap and extends over the tunnel to a discharge end, which either opens into the tunnel or through the transom of the watercraft hull.

The personal watercraft 10 so far described represents only an exemplary watercraft in which the present bulkhead location mechanism can be employed. A further description of the personal watercraft 10 is not believed necessary for an understanding and an appreciation of the present invention. The hull construction will now be described in greater detail.

As best understood from FIG. 2, the upper deck 16 and the lower hull portion 14 together define a pair of raised gunnels 56 positioned on opposite sides of the aft end of the upper deck assembly 16. The raised gunnels 56 define a pair of foot areas and aft deck (referenced collectively by reference numeral 57) that extend generally longitudinally and parallel to the sides of the watercraft 10. In this position, the operator and any passengers sitting on the watercraft 10 can place their feet in the foot areas 57 with the raised gunnels 56 shielding the feet and lower legs of the riders. A non-slip (e.g., rubber) mat desirably covers the foot areas and deck 57 to provide increased grip and traction for the operator and the passengers.

Toward the aft end of the watercraft, a seat pedestal 58 rises above the foot areas. The pedestal 58 supports a seat cushion 60 to form a seat assembly. In the illustrated embodiment, the seat assembly has a longitudinally extending straddle-type shape which may be straddled by an operator and by at least one or two passengers. For this purpose, the raised pedestal 58 has an elongated shape and extends longitudinally along the center of the watercraft 10. The seat cushion 60 desirably is removably attached to the pedestal 58 by a quick-release latching assembly, as known in the art. An access opening (not shown) can be formed, at least in part, beneath the seat cushion 60 to provide access into the engine compartment 37.

A control mast 62 is positioned just forward of the seat 60. The control mast 62 includes a steering column that supports a steering operator. In the illustrated embodiment, the steering operator is a handlebar assembly; however, other steering operators, such as, for example, a steering wheel or a control stick (i.e., joystick), also can be used. The steering column operates a steering actuator. A lever projects from a lower end of the steering column 84. An end of a steering cable, such as a bowden-wire actuator, is attached to the lever such that rotational movement of the steering column actuates the steering cable in a conventional manner. The bowden-wire actuator in turn moves the steering nozzle 32 to effect directional changes of the watercraft 10.

The bulkhead 41 is positioned within the hull 12 at a location forward of the tunnel 18. The bulkhead 44 essentially divides the hull to form the engine compartment 37 and the pump chamber 39, and thus lies forward of the tunnel 18. As best seen in FIG. 2, the bulkhead 41 has a shape that generally matches the cross-sectional shape of the hull 12, as defined between the lower hull section 14 and the upper deck section 16. The bulkhead 41 also includes several opening and through holes 64 through which various electrical wires, mechanical cables and fluid tube and conduits extend.

A central boss 66 with an inner hole that extends through the bulkhead 41. The hole of the central boss 66 is sized to receive the impeller shaft 36 with the bearing assembly 51 mounted on the front side of the bulkhead 41.

A mounting flange 68 extends about the periphery of a planar body of the bulkhead 41. The flange 68 has a generally flat outer surface or foot that is contoured to follow the interior of the hull 12. When assembled, the flange 68 desirably is bonded to the lower hull section 14. And although the flange 68 is not illustrated as bonded to the upper deck section 14, in some applications it can be so bonded.

The bulkhead 41 is desirably formed using a sheet molding compound (SMC), i.e., a mixed mass of reinforced fiber and thermosetting resin. The SMC material is laid-up in one half of a male and female mold, and is then compressed and heated within the mold in a manufacturing process similar to that used with the upper and lower sections of the hull, as described above.

A locator mechanism desirably operates between the bulkhead 41 and the hull 12 in order to establish a desired position and possibly a desired orientation of the bulkhead 41 within the hull 12. In the illustrated embodiment, the locator mechanism is formed between members on the hull 12 and the bulkhead 41; however, it is understood that the locator mechanism can also include a separately molded piece that is later affixed to the hull 12.

With reference now to FIGS. 2 through 5, the locator mechanism includes a plurality of bosses 70 formed on the bottom wall 15 of the lower hull section 14. In the illustrated embodiment, the locator mechanism includes a first pair of bosses 70*a* aligned along a first lateral axis, which is generally normal to the longitudinal axis of the hull 12, and a second pair of bosses 70*b* aligned along a second lateral axis, which is parallel to and behind the first lateral axis. The pair of bosses 70*a*, 70*b* are arranged such that each boss 70 within the pair lies closer to a side wall 17 than to the longitudinal center of the hull 12. The bosses 70 within each pair 70*a*, 70*b* desirably are positioned symmetrically relative to the longitudinal center line. And the bosses 70 of the pairs 70*a*, 70*b* that lie on the same side of the center line, are aligned along a line that is generally parallel to the center line.

Each boss 70 includes a base 72 that extends upward from the bottom wall 15 and terminates at a generally flat mounting surface 74. All of the mounting surfaces 74 of the bosses 70 desirably lie within the same horizontal plane (i.e., a plane parallel to the lateral and longitudinal axes). A cylindrical post 76 extends upward from the mounting surface 74. The post 76 has a smaller diameter than the base 72. A bore 78 extends into the boss 70 from the top side of the post 76.

Lugs 80 formed on the bulkhead 41 also form part of the locator mechanism. In the illustrated embodiment, the bulkhead 41 includes four lugs 80: two 80*a* that extend forward from a front side of the bulkhead 41, and two 80*a* that extends rearward from an aft side of the bulkhead 41. The lugs 80 are arranged on the bulkhead 41 to generally correspond to the position of the bosses 70. That is, with the bulkhead 41 positioned within the hull 12 between the first and second lateral axes, each lug 80 will generally extend over one of the bosses 70.

Each lug 80 includes a flange member 82 that cantilevers from the respective surface of the bulkhead 41. The flange member 82 desirably lies generally normal to the plane defined by the bulkhead 41. Stiffening ribs 84 also extend from the bulkhead 41. The ribs 84 are arranged on both lateral sides of the flange member 82 and on the upper and lower sides of the flange member 82. Flat mounting surfaces 86 are formed on opposite sides of the flange member 82, in a central section lying between the stiffening ribs 84. The bottom mounting surfaces 86 of the flange member 82 desirably lie within the same horizontal plane. In the illustrated embodiment, the lugs 80 are integrally formed with the bulkhead 41; however, it is understood that the lugs 80 can be attached to the bulkhead 41 in any of a variety of well known ways.

Each lug 80 also includes an opening 88 formed in the central section of the flange member 82. The opening 88 is sized to receive the post 76 of the corresponding boss 70. However, the openings 88*a* of the front side lugs 80*a* and the openings 88*b* of the aft side lugs 80*b* desirably differ in shape.

Figure 4:
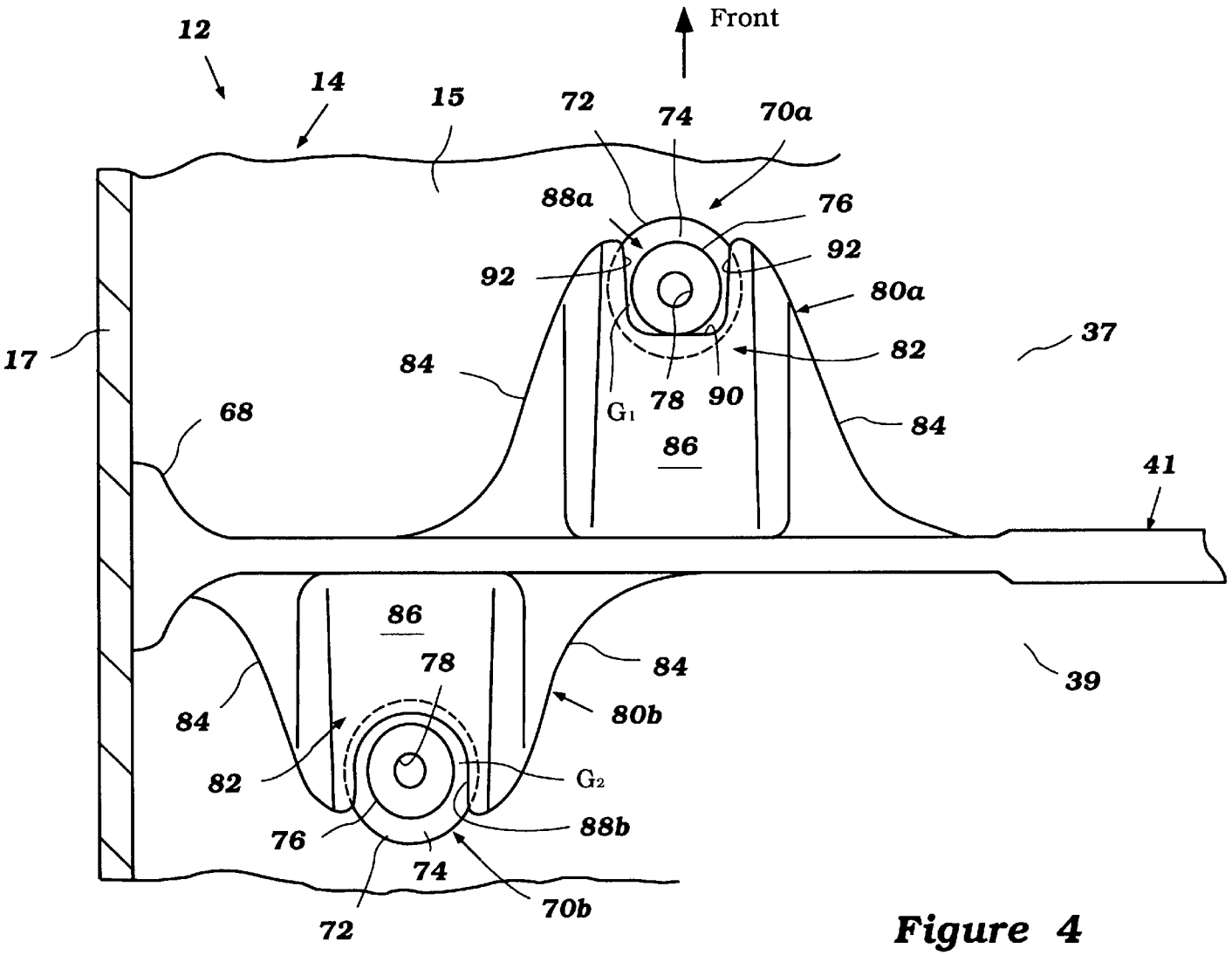
FIG. 4 is an enlarged partial top plan view of the bulkhead assembly without the fasteners shown in FIG. 3.

As best seen in FIG. 4, the opening 88*a* of the front side lug 80*a* generally has a U-shape and extends into the lug 80*a* from a front end. An inner edge 90 of the lug 80*a* that defines the opening 88*a* has a generally flat shape to form an abutment surface. The abutment surfaces 90 of each front lug 80*a* desirably are aligned along the a common lateral axis. The opening 88*a* has a width, as measured in the lateral direction between side walls 92, that is larger than the diameter of the corresponding post 76, but is smaller than the diameter of the boss base 72.

The opening 88*b* on the aft side lug 80*b* generally has an arcuate, concave shape that is defined by a radius of curvature. The radius of curvature of the opening 88*b* desirably is greater than the radius of the boss post 76, but is smaller than the radius of the boss base 72. The opening 88*b* extends into the lug 80*b* from an aft end.

When assembled, the bulkhead 41 is inserted into the hull lower section 14 to lie in position between the side walls 17 and generally normal to the longitudinal axis. It also is located in a generally upright position.

To use the locator mechanism, the bulkhead 41 is placed between the two rows of bosses 70*a*, 70*b* (i.e., between the first and second lateral axes). The lugs 80*a*, 80*b* are arranged to extend over the corresponding bosses 70 with the posts 76 of the bosses 70 extending up into the corresponding openings 88. The bulkhead 41 is then slid forward until the posts 76 of the front side bosses 70*a* contact the abutment surfaces 96 within the corresponding openings 88*a* for the front side lugs 80*a*. This contact or interaction between the posts 76 and the lug abutment surfaces 90 establish the longitudinal location of the bulkhead 41 within the hull. In addition, this interaction with the two front posts 76 on either side of the longitudinal center line also defines lateral orientation of the bulkhead 41 (which desirably is generally perpendicular to the longitudinal axis of the hull 12).

As best seen in FIG. 4, the larger sized openings 88, relative to the post size, provide clearance gaps $G_1$, $G_2$, between the openings 88 and the posts 76. The clearance $G_1$ between the respective post 76 and the front side lug 80*a* exists in the lateral direction (i.e., to the side of the post 76) to provide a degree of adjustment to the bulkhead 41 to account for manufacturing tolerances in the molded hull lower section 14 and the bulkhead 41. The clearance $G_2$ between the corresponding post 76 and the aft side lug 80*b* exists in the lateral direction as well as in the longitudinal direction. The clearance $G_2$ in some applications, as seen in FIG. 4, thus extends entirely around the post 76 (i.e., the lug 80*b* does not contact the post 76). This clearance $G_2$ provides a degree of adjustment to the bulkhead 41 to account for manufacturing tolerances in the lateral direction and also in the longitudinal direction between the front and aft bosses 70.

Figure 5:
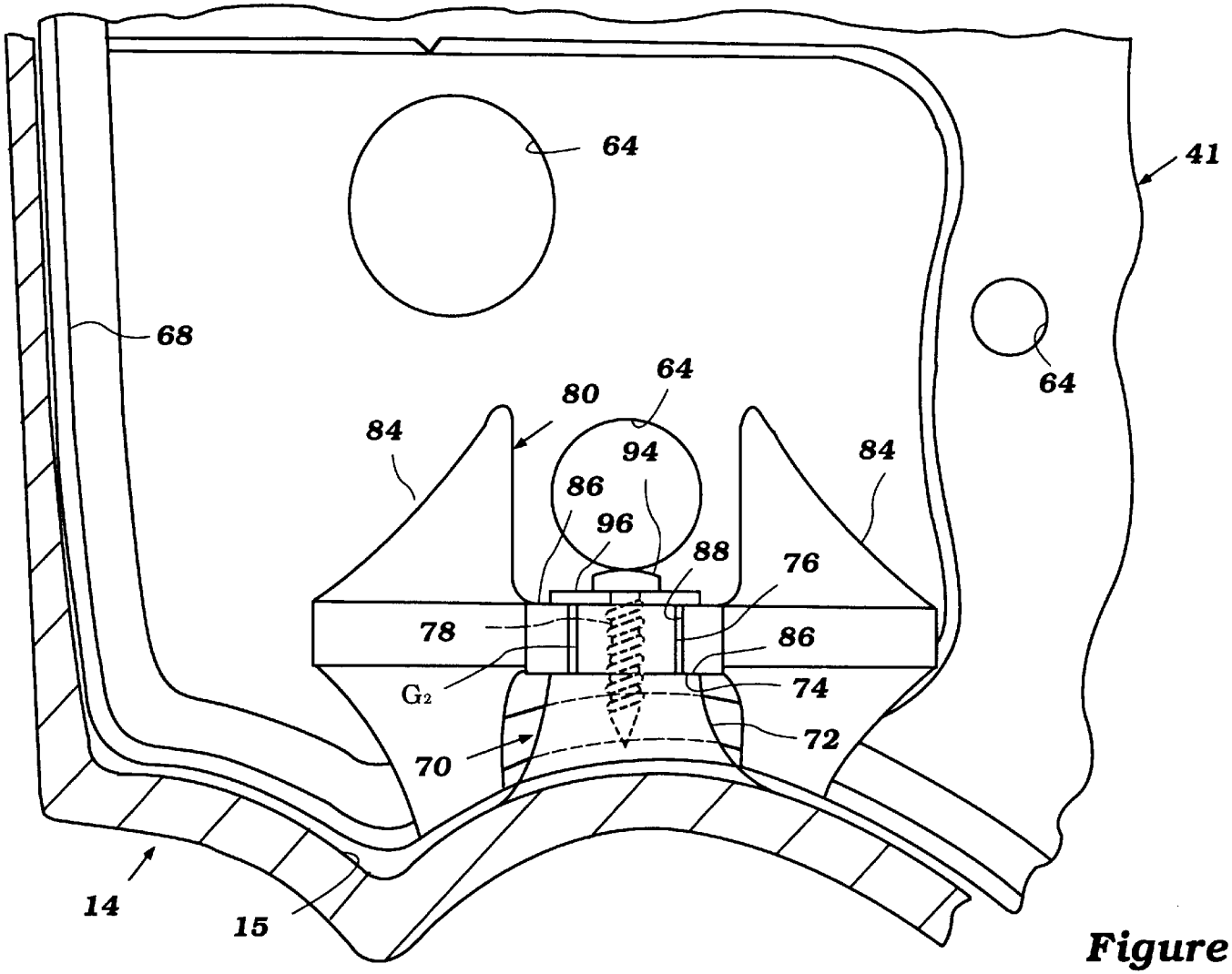
FIG. 5 is an enlarged, partial cross-sectional view of the hull of FIG. 2 and illustrates one of the stationary locator mounts of the bulkhead.

As best seen in FIGS. 4 and 5, portions of the lug flat mounting surfaces 86 rest atop the mounting surfaces 74 of the corresponding boss bases 72 with the bulkhead 41 position as described above. This support of the flange members 82 by the bases 72 on either side of the bulkhead 41 and generally within the same horizontal plane, establishes a desired upright orientation for the bulkhead 41.

Fasteners desirably attach the lugs 80 to the bosses 70 in order to fix the above described position and orientation of the bulkhead 41 within the hull 14. In the illustrated embodiment, the fasteners are screws 94 that thread into the bores 78 of the bosses 70. A washer 96 of the fastener is positioned between the screw head and the respective flange upper mounting surface 86 in order to compress and capture a portion of the lug 80 between the screw 94 and the boss 70. In this manner the lugs 80 and bosses 70 are connected together. It is understood, however, that other types of fasteners (e.g., rivets, clips and the like) can be used as well. The fasteners also can be used either alone or in combination with a bonding agent employed between the respective lug and boss pairings. In addition, this form of coupling can be used as the sole means of attaching the bulkhead 41 to the hull lower section 14; however, the bulkhead 41 also is desirably bonded to the hull lower section 41 about the peripheral flange 68, as described above.

The locator mechanism employed between the bulkhead 41 and the hull 12 thus establishes a desired location of the bulkhead 41 along the longitudinal axis of the watercraft 10, as well as defines at least in part the lateral and vertical orientations of the bulkhead 41 within the hull 12. The components of this mechanism also can be integrally formed with the bulkhead 41 and the hull 12 to eliminate the need for additional tooling, for instance, a jig, to establish the position of the bulkhead 41 within the hull 12. Assembly of the watercraft 10 consequently is eased and labor costs reduced, while improving the accuracy of the bulkhead position within the hull is improved.

Although this invention has been described in terms of a certain preferred embodiment, other embodiments apparent to those of ordinary skill in the art are also within the scope of this invention. For instance, it is understood that some of all of any male components of the locator (e.g., the posts) can be formed on the bulkhead and the corresponding female components (e.g., the openings) can be formed in the hull. It is also understood that other types of interacting structures can be employed between the bulkhead and hull, and that such structures need not be integrally formed with either the bulkhead or the hull. Accordingly, the scope of the invention is intended to be defined only by the claims that follow.

What is claimed is:

1. A watercraft comprising a hull having a longitudinal axis extending between fore and aft ends and being formed at least in part by a pair of side walls and a bottom wall that interconnects and separates at least corresponding portions of the side walls, a plurality of bosses formed on the bottom wall and arranged in a lateral direction that lies generally normal to the longitudinal axis, each boss including a post, and a bulkhead positioned between the corresponding side wall portions and above the bottom wall, the bulkhead including a plurality of lugs that are arranged to cooperate with the bosses when the bulkhead is properly positioned within the hull, each lug including an opening to receive the post of the corresponding boss, and each opening having a width, as measured in the lateral direction, that is larger than a width of the corresponding post to form an adjustment gap at least in the lateral direction.

2. The watercraft as in claim 1, wherein at least some of the lugs are arranged on a fore side of the bulkhead, and each opening of the fore side lugs extends into the respective lug from a front end of the lug and terminates at an abutment surface that is located at a position to interact with the corresponding post.

3. The watercraft as in claim 1, wherein said bulkhead is formed of a sheet molding compound (SMC) comprising a mixed mass of a reinforced fiber and thermosetting resin.

4. A watercraft as in claim 1 additionally comprising a plurality of fasteners, each fastener attaching to one of the bosses with a portion of the respective lug captured between the fastener and the boss.

5. A watercraft as in claim 4, wherein each fastener comprises a screw and a washer.

6. A watercraft comprising a hull having a longitudinal axis extending between fore and aft ends and being formed at least in part by a pair of side walls and a bottom wall that interconnects and separates at least corresponding portions of the side walls, a bulkhead positioned between the corresponding side wall portions and above the bottom wall, and the hull including at least two locator members spaced apart so as to be distinct from one another and integrally formed with the hull, the locator members arranged to interact with the bulkhead to establish a location of the bulkhead along the longitudinal axis of the hull and an orientation of the bulkhead between the walls.

7. A watercraft as in claim 6, wherein at least one of said locator members is located on the bottom wall.

8. A watercraft as in claim 7, wherein the locator member on the bottom wall is arranged to lie forward of the bulkhead within the hull.

9. A watercraft as in claim 6, wherein said hull includes a tunnel formed on an under surface of the hull near the aft end and an engine compartment located forward of the tunnel, and the bulkhead is located between the tunnel and the engine compartment.

10. A watercraft comprising a hull having a longitudinal axis extending between fore and aft ends and being formed at least in part by a pair of side walls and a bottom wall that interconnects and separates at least corresponding portions of the side walls, a bulkhead positioned between the corresponding side wall portions and above the bottom wall, and locator members positioned between the bulkhead and the hull and arranged to interact with one another to establish a location of the bulkhead along the longitudinal axis of the hull and an orientation of the bulkhead between the walls, the hull including at least two locator members that interact with the bulkhead, and the bulkhead including at least two locator members, each locator member interacting with a respective one of the locator members of the hull, and each locator member of the hull comprising a post which is received by an opening in the corresponding locator member of the bulkhead.

11. A watercraft comprising a hull having a longitudinal axis extending between fore and aft ends and being formed at least in part by a pair of side walls and a bottom wall that interconnects and separates at least corresponding portions of the side walls, a bulkhead positioned between the corresponding side wall portions and above the bottom wall, and locator members positioned between the bulkhead and the hull and arranged to interact with one another to establish a location of the bulkhead along the longitudinal axis of the hull and an orientation of the bulkhead between the walls, the interacting locator members comprising at least two pairings of a post and a corresponding opening that receives the post.

12. A watercraft as in claim 11, wherein the posts are connected to the hull and the openings are arranged on the bulkhead.

13. A watercraft as in claim 12, wherein the hull includes a plurality of bosses formed on the bottom wall, and each boss supports one of the posts.

14. A watercraft as in claim 13, wherein the bosses and the posts are integrally formed with the bottom wall.

15. A watercraft as in claim 13, wherein the bulkhead includes a plurality of lugs arranged on the bulkhead to cooperate with the bosses of the hull bottom wall, and one of the openings is formed in each lug.

16. A watercraft as in claim 15, wherein the bulkhead additionally include a generally planar body, and the lugs and the body are integrally formed.

17. A watercraft as in claim 16, wherein said bulkhead is formed of a sheet molding compound (SMC) comprising a mixed mass of a reinforced fiber and thermosetting resin.

18. A watercraft as in claim 15 additionally comprising a plurality of fasteners, each fastener attaching to one of the bosses with a portion of the respective lug captured between the fastener and the boss.

19. A watercraft as in claim 18, wherein each fastener comprises a screw and a washer.

20. A watercraft as in claim 15, wherein at least some of the lugs are arranged on a fore side of the bulkhead, and each opening of the front side lugs extends into the respective lug from a front end of the lug and terminates at an abutment surface that is located at a position to interact with the corresponding post.

21. A watercraft as in claim 20, wherein the openings of the front side lugs have a width, as measured in a lateral direction that is generally normal to the longitudinal axis of the hull, that is larger than a width of the post.

22. A watercraft as in claim 20, wherein at least some of the lugs are arranged on an aft side of the bulkhead, and each opening of the aft side lugs generally has a concave shape and extends into the respective lug from an aft end of the respective lug with the opening being sized to receive the corresponding post with a degree of clearance existing between the post and at least a portion of the corresponding opening.

23. A watercraft as in claim 15, wherein at least some of said bosses are arranged on the bottom wall of the hull along a line that is generally normal to the longitudinal axis.

24. A watercraft as in claim 15, wherein at least one of the bosses is located at a position closer to one of the side walls than to a center point between the walls that lies along the longitudinal axis of the hull.

25. A watercraft comprising a hull having a longitudinal axis extending between fore and aft ends and being formed at least in part by a pair of side walls and a bottom wall that interconnects and separates at least corresponding portions of the side walls, the hull including a tunnel formed on an underside of the hull, a bulkhead positioned forward of the tunnel and between the corresponding side wall portions and above the bottom wall, and at least two locator means for establishing a location of the bulkhead along the longitudinal axis of the hull and an orientation of the bulkhead between the walls, the at least two locator means being spaced apart from each other between the side walls and below an upper edge of the bulkhead.

26. A watercraft as in claim 25 additionally comprising a plurality of fasteners that at least in part couple the bulkhead to the hull.

27. A watercraft comprising a hull having a longitudinal axis extending between fore and aft ends and being formed at least in part by a pair of side walls and a bottom wall that interconnects and separates at least corresponding portions of the side walls the hull including a tunnel formed on an underside of the hull, a bulkhead positioned forward of the tunnel and between the corresponding side wall portions and above the bottom wall, and locator means for establishing a location of the bulkhead along the longitudinal axis of the hull and an orientation of the bulkhead between the walls, the locator means being positioned to operate between the bottom wall of the hull and a lower portion of the bulkhead.

28. A watercraft as in 27, wherein the locator means lies at least in part in front of the bulkhead.

29. A method of manufacturing a hull of a watercraft comprising the steps of:

forming a hull having a longitudinal axis extending between fore and aft ends, the hull being formed at least in part by a pair of side walls and a bottom wall that interconnects and separates at least corresponding portions of the side walls;

forming bosses on the bottom surface of the hull with the bosses arranged in a lateral direction that is generally normal to the longitudinal direction, each boss being formed with a generally upright post;

forming a bulkhead sized to fit between the side walls in a position generally normal to the longitudinal axis of the hull, the bulkhead being formed with lugs that include openings sized to receive the posts;

positioning the bulkhead within the hull between the side walls and above the bottom wall with at least portions of each lug being positioned above a corresponding boss;

inserting the post of each boss into the corresponding hole in the respective lug; moving the bulkhead along the longitudinal axis toward the fore end of the hull to interact at least some of the posts with abutment surfaces formed within the corresponding openings; and coupling the bulkhead to the hull.

30. A watercraft comprising a hull having a longitudinal axis extending between fore and aft ends and being formed at least in part by a pair of side walls and a bottom wall that interconnects and separates at least corresponding portions of the side walls, a bulkhead positioned between the corresponding side wall portions and above the bottom wall, and locator members positioned between the bulkhead and the hull and arranged to interact with one another to establish a location of the bulkhead along the longitudinal axis of the hull and an orientation of the bulkhead between the walls, the hull including at least two locator members that interact with the bulkhead, and at least one of said locator members is located on the bottom wall, the bulkhead also including at least two locator members that project from the bulkhead, each locator member of the bulkhead interacting with a respective one of the locator members of the hull.

31. A watercraft as in claim 30, wherein each locator member of the hull comprises a post which is received by an opening in the corresponding locator member on the bulkhead.

32. A watercraft comprising a hull having a longitudinal axis extending between fore and aft ends and being formed at least in part by a pair of side walls and a bottom wall that interconnects and separates at least corresponding portions of the side walls, a bulkhead positioned between the corresponding side wall portions and above the bottom wall, and at least two locator members spaced apart from each other between the side walls and below an upper edge of the bulkhead, the locator members also positioned between the bulkhead and the hull and arranged to interact with one another to establish a location of the bulkhead along the longitudinal axis of the hull and an orientation of the bulkhead between the walls.

33. A watercraft as in claim 32, wherein at least a portion of at least one of the locator members is integrally formed with the hull.

34. A watercraft as in claim 32, wherein each locator member of the hull comprises a post which is received by an opening in the corresponding locator member on the bulkhead.

* * * * *